United States Patent [19]

Gresens et al.

[11] Patent Number: 4,846,386

[45] Date of Patent: Jul. 11, 1989

[54] MATERIAL STORE FOR THE THROUGH TRANSPORT OF A LENGTH OF TEXTILE MATERIAL

[75] Inventors: Harry Gresens, Benningen/Neckar; Jörg Müller, Waiblingen-Hohenacker, both of Fed. Rep. of Germany

[73] Assignee: Bruckner Trockentechnik GmbH & Co. KG, Fed. Rep. of Germany

[21] Appl. No.: 132,505

[22] Filed: Dec. 14, 1987

[30] Foreign Application Priority Data

Dec. 19, 1986 [DE] Fed. Rep. of Germany ..... 3643545

[51] Int. Cl.[4] ..... B65H 20/24; D06B 17/02

[52] U.S. Cl. ..... 226/118; 226/119; 68/178

[58] Field of Search ..... 226/118, 119, 189; 68/178

[56] References Cited

U.S. PATENT DOCUMENTS

| | | | |
|---|---|---|---|
| 2,913,973 | 11/1959 | Bull et al. | 226/189 X |
| 2,991,920 | 7/1961 | Emslie et al. | 226/118 |
| 3,019,631 | 2/1962 | Freyberg | 226/118 X |
| 4,326,791 | 4/1982 | Beer et al. | 226/189 X |
| 4,394,951 | 7/1983 | Ruda et al. | 226/118 |
| 4,591,084 | 4/1986 | Balian et al. | 226/118 |

*Primary Examiner*—Stuart S. Levy
*Assistant Examiner*—Steven M. DuBois
*Attorney, Agent, or Firm*—Sheldon & Mak

[57] ABSTRACT

The invention relates to a material store for the through transport of a length of textile material. It contains a storage vessel with an upright delivery shaft, an upright extraction shaft and a turn-round section which connects the lower ends of the shafts, and transport arrangements for the delivery and removal of the length of material are provided above the two shafts. In the turn-round section of the storage vessel the length of material is turned round with the aid of a rotating turn-round device and a break roller can be pivoted from the inner face of each of the shafts into the cross-section of the shaft.

By these means the length of material is transported through the storage vessel satisfactorily and extremely gently with an extremely high degree of stabilization.

10 Claims, 1 Drawing Sheet

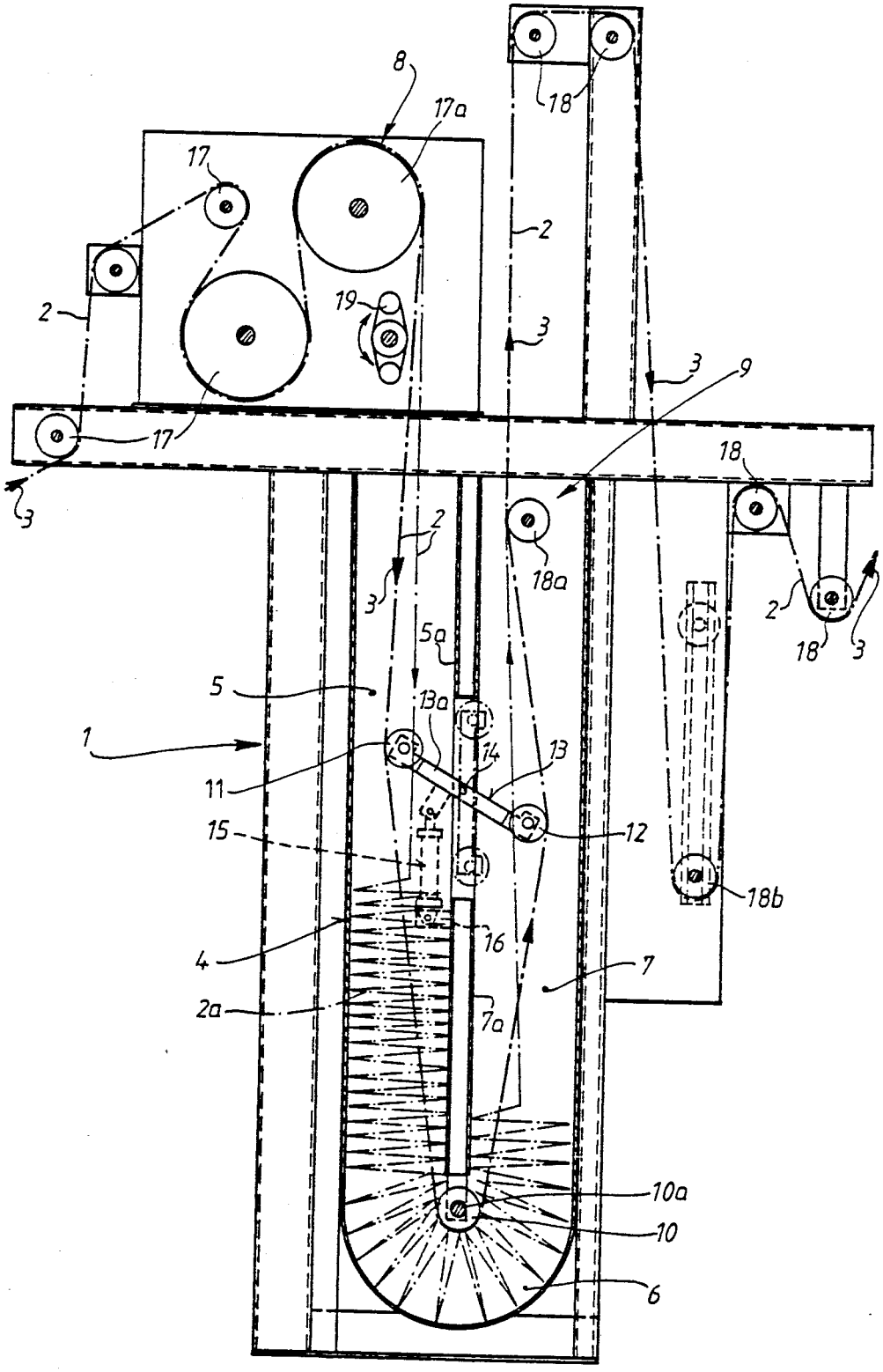
8
17a
17
18
2
19
3
9
17
18
3
2
18a
3
2
18
3
5a
5
13a
1
14
13
11
12
15
18b
16
4
7
2a
7a
10a
10
6

MATERIAL STORE FOR THE THROUGH TRANSPORT OF A LENGTH OF TEXTILE MATERIAL

BACKGROUND

The invention relates to a material store for the through transport of a length of textile material between successive treatment machines, according to the preamble to claim 1.

The finishing of lengths of textile material should be carried out as much as possible without interruptions. In order to produce constant material quality. If, for example, a first section of a length of textile material which has been treated in any way is then to be further treated in a so-called stentering frame, especially dried and/or fixed, and immediately thereafter a similar section (same batch) is to be treated in exactly the same manner, then it is usual to draw the beginning of the immediately following section of the length of material near to the end of the first section. If for example the stentering frame were to be stopped for this purpose in order to bring the next section of the length of material near to the one which has just been finished, this would mean that the standing section of material just located in the stentering frame is subjected to a longer period of heat treatment, and therefore has a different quality. In order to avoid such periods of idleness during the finishing process material stores are used.

Various constructions of material stores for the transport of lengths of textile material, particularly those which are guided widthways, are known in the art.

One known construction uses a so-called roller material store in which upper and lower rows of rollers are provided and the length of material is guided to and fro a number of times over a plurality of rollers, the distance between the upper and lower rows of rollers being variable.

Such a material store has significant disadvantages. First of all, because of the large number of rollers and the movable mounting thereof, the expenditure on construction is considerable. Moreover, care must be taken to ensure that the successive rollers do not have too small a diameter and with a view to simple feeding in of the length of material the rollers must be a sufficiently large distance apart, this distance generally being greater than their diameter. This results in very large dimensions for a roller material store, and there is not generally sufficient space for this in textile finishing plant.

It is also known in the art to use a material store of the type set out in the introduction in the farm of a socalled J box, in which the two inner and outer side plates are bent in the shape of a J, arranged a sufficiently large distance apart and connected to one another by two J-shaped side walls. In this way the J box material store has a relatively high vertical shaft for delivery of the length of material, a turn-round section adjoining the lower end of this shaft and if require a short extraction shaft which is generally connected to the turn-round section and runs upwards at an angle. As in the roller material store, this J box material store is also filled with material, the material being fed into the vertical delivery shaft at an increased delivery speed (fast running). The length of material slips downwards through the delivery shaft and can be removed from the curved turn-round section or from the adjoining extraction shaft and delivered to the next treatment machine (e.g. stentering frame).

However, because of its design and construction this known J box material store cannot be completely emptied, since otherwise the length of material would slide along the plates resulting in damage to the finished length of material.

For certain types of material it is important that they are not stored for long in folded form since otherwise there is a danger of permanent fold marks. Therefore these types of material must be introduced into the aforementioed material store in such a way that they are only stored there during the relatively short material batch changing process; then they must be removed from the store immediately so that they can run fold-free through this material store in normal operation.

The object of the invention, therefore, is to make further developments to a material store of the type comprising a storage vessel with a substantially upright delivery shaft, a turn-round section connected directly to the lower end of the delivery shaft, an extraction shaft connected to the turn-round section opposite the delivery shaft, and transport arrangements arranged above the delivery shaft and the extraction shaft to delivery and remove the length of material in such a way that with a relatively simple and compact construction it is ensured that a length of textile material is guided through gently and reliably and if required there is a sufficient storage capacity at least in the region of the delivery shaft.

SUMMARY

This object is achieved according to the invention which comprises a rotating turn-round device arranged at the upper end of the turn-round section and in the transition region thereof from the lower end of the delivery shaft to the lower end of the extraction shaft and a break roller which can be moved into the cross-section of the appertaining shaft from the adjacent interfaces of the two shafts located in the region between the lower and upper ends of each of the two shafts.

In this construction according to the invention, the rotating turn-round device arranged at the upper end of the turn-round section and in the transition region thereof from the lower end of the delivery shaft to the lower end of the extraction shaft ensures that the length of material to be transported through the storage vessel is always reliably and gently turned and guided at the bottom both when this length of material is being freely transported through the storage vessel and when the length of material is passing through the storage vessel in the stowed, i.e. stored, state. The length of material can then be removed upwards out of the extraction shaft without any problem at all, that is to say the next treatment machine for the length of material can operate without interruption. In order to achieve a sufficiently long period of time for appropriate manipulation (e.g. drawing the beginning of a new length of material near to the end of the length of material which has already been treated) in the region of the delivery shaft of the material store, with the present-day high machine speeds at which the succeeding treatment machines operate, a sufficiently large quantity of material must pass into the material store. This necessitates a sufficient height of the shafts for delivery and extraction of the length of material, resulting in a correspondingly large distance between the turn-round device in the turn-round section and the corresponding transport arrangements above the shafts.

When the length of material is being transported freely (that is to say when no storage effect is desired and necessary), in order to ensure that the length of material can always be guided satisfactorily through the material store, even with very high shafts, a break roller which can be moved into the shaft cross-section from the adjacent inner faces of the two shafts is provided in the region between the lower and upper ends of each of the two shafts, that is to say in each of the associated runs of material a break roller is moved into the path of the material so as to ensure the desired stabilisation of the run of material.

According to an advantageous embodiment of the invention the storage vessel is of approximately U-shaped construction in vertical section, the delivery and extraction shafts are of approximately the same height and extend substantially parallel to one another and form the two arms of the U, and the distance between the adjacent inner faces of these two shafts is smaller than the diameter of the rotating turn-round device. This construction makes it possible to have shafts of any height into which the length of material is guided essentially vertically and out of which this length of material can be transported again essentially vertically. In this way a comparatively large storage capacity can be achieved in a relatively confined space (compact). The two shafts can be arranged relatively close to one another, with their adjacent near faces only a comparatively small distance apart. Since the rotating turn-round device has a diameter somewhat greater than the distance between the two adjacent inner faces of the shafts, the length of material is prevented from sliding along the inner faces of the shafts.

Further details and advantageous embodiments of the invention are set forth below.

BRIEF DESCRIPTION OF THE DRAWING

The invention will be explained in greater detail below with the aid of the drawing. This drawing shows in one single figure a largely schematic vertical section (viewed in the material transport direction) through the material store according to the invention.

DESCRIPTION

This material store 1 according to the invention is so constructed that a length of textile material 2 which is guided widthways can be transported through it in the direction of the arrows 3. This means that the length of material 2 on the one hand (during the normal continuous treatment of the length of material) is passed continuously through the storage vessel 4 which forms an essential part of the material store without any significant storage effect (cf, the length of material 2 shown in thick dash-dot lines), whilst on the other hand a sufficiently large stock of material can be stored in the storage vessel 4, while the length of material 2 is transported into the storage vessel 4 at a higher delivery speed but is then transported out of this storage vessel 4 at the normal speed (this state is represented in thinner dash-dot-dash lines in the drawing, in which the stock of material is indicated by 2a). This material store 1 is a dry material store, that is to say no wet processing of the length of material 2 is carried out (i.e. there is no fluid bath or fluid application means), although the length of material itself can be previously wet processed or impregnated in some other way. Material stores of this type are generally arranged before further treatment machines, such as for example stentering frames for drying and fixing a finished length of material.

The illustrated material store 1 contains as essential parts the storage vessel 4 which has already been mentioned with an upright delivery shaft 5, a turn-round section which is directly connected to the lower end of this delivery shaft 5 and turns the material round by approximately 180°, and an extraction shaft 7 arranged opposite the delivery shaft 5 and connected to the turn-round section 6, as well as a first transport arrangement 8 arranged above the delivery shaft 5 to deliver the length of material 2 into the storage vessel 4 and a second transport arrangement 9 arranged substantially above the extraction shaft 7 to remove the length of material 2 from the storage vessel 4.

As shown in the drawing, the storage vessel 4 is approximately U-shaped in vertical section (i.e. in the vertical longitudinal section with respect to the material transport direction), and the two shafts 5 and 7 of equal height extend vertically and substantially parallel to one another and form the two arms of the U which are connected to one another at their lower ends, substantially without a transition, by the turn-round section 6 so that a continuous U-shaped shaft is produced. These two shafts 5 and 7 lie close to one another with their inner faces (inner walls) a relatively small distance apart and have a sufficiently large internal cross-section which is adapted to the desired storage volume and to the lengths of material which are preferably to be treated.

At the upper end, i.e. to a certain extent the upper boundary wall, of the turn-round section 6 and in the transistion region thereof from the lower end of the delivery shaft to the lower end of the extraction shaft there is a rotating turn-round device for the length of material 2 which is formed in this preferred embodiment by a guide roller 10. This turn-round roller 10 is mounted so as to be freely rotatable in the side walls which face one another of the storage vessel 4 (not shown in greater detail as it is a conventional mounting) and it is arranged so as to be stationary. The diameter of this turn-round roller is—as illustrated in the drawing—somewhat larger than the distance between the adjacent inner faces 5*a* and 7*a* of the two shafts 5 and 7, so that the length of material cannot slide along the inner walls during its free passage through the storage vessel 4.

A break roller 11 or 12 which can be moved from the adjacent inner faces 5a and 7a of the shafts into the cross-section of the appertaining shaft 5 or 7 respectively is provided in the region between the lower and upper ends of the two shafts 5, 7. These two break rollers 11 and 12 are mounted a certain distance apart and parallel to one another on opposite sides of a common pivot frame 13 which is pivotable about an axis 14 which runs parallel to the break rollers 11, 12 and to the axis of rotation 10*a* of the turn-round roller between a first, active position (cf. solid lines in the drawing) and a second, rest position (cf. dash-dot position in the drawing). In the first, active position of the pivot frame 13 the two break rollers 11, 12 are pivoted into the appertaining shafts 5 and 7 respectively for the purpose of guiding the length of material, whilst in the second, rest position the pivot frame 13 is preferably kept approximately vertical and the two break rollers 11, 12 are pivoted out of the region of the length of material 2 located in the shafts 5, 7. The pivot frame 13 is constructed in the manner of a two-armed (preferably equal-armed) lever, with a suitable pivot drive 15 engaging on one lever arm 13a. This pivot drive can be any suitable motor or manual drive; however, the preferred form of drive is a conventional cylinder-piston unit 15 (as shown) which is driven by a pressure medium and can have one end mounted on a suitable fixing 16 on the exterior of the storage vessel so as to be stationary.

As can also be seen in the drawing, in this embodiment of the material store 1 the pivot frame 13 with its lever arms are preferably constructed in such a way that in its rest position it is accommodated in the region between the adjacent inner faces 5*a* and 7*a*of the two shafts 5, 7 (cf. dash-dot lines in the drawing).

Optionally, especialy for use in material stores 1 having relatively long shafts 5 and 7, one or more additional sets of break rollers (not shown) can be disposed above or below break rollers 11 and 12.

The first transport arrangement 8 provided above the delivery shaft 5 contains a plurality of transport and guide rollers 17 which are constructed in a conventional manner and in some cases have differing diameters, the last roller 17*a*of which—viewed in the material transport direction (arrow 3)—being arranged above the upper end of the delivery shaft 5 in such a way that the length of material 2 can be delivered approximately vertically and centrally from above into this shaft 5.

The second transport arrangement 9 which to a considerable extent is provided above the extraction shaft 7 also contains a number of transport and guide rollers 18 which are assembled in a suitable manner and are of conventional construction, of which at least the first roller 18*a* again viewed in the material transport direction (arrow 3)—is arranged above the upper end of this extraction shaft 7 in such a way that the length of material 2 can be transported essentially vertically and centrally out of this shaft 7.

Furthermore, in the case of this transport arrangement 9 it can also be advantageous if—viewed in the transport direction (arrow 3) of the length of material 2—one of the rear rollers 18*b* is constructed and retained in the form of a compensating roller 18*b* which can be moved upwards and downwards in the vertical direction (as is known per se in apparatus of this type).

A layering device 19 of conventional construction which can be switched on and off can also be arranged between the upper end of the delivery shaft 5 and the last roller 17*a*of the first transport arrangement 8 in order to be able to feed the length of material 2 in the folded state into the storage vessel 4, particularly into the delivery shaft and the adjoining turn-round section 6, as is indicated schematically in the drawing by the folded state of the stored stock of material 2*a*.

To enable the length of material 2 if necessary on the one hand to be transported out of the extraction shaft 7 at the normal transport speed with the aid of the second transport arrangement 9, but to be stored in the desired manner in the turn-round section 6 and delivery shaft 5, it is advantageous to drive the transport and guide rollers 17 and 17*a*of the first transport arrangement 8 (above the delivery shaft 5) at a variable speed. In this way these transport and guide rollers 17, 17*a*can be driven at the same speed as the transport and guide rollers 18, 18*a*, 18*b* of the second transport arrangement 9 during the normal passage of the length of material through the storage vessel 4, whereas in order to create a stored stock of material 2*a* in the storage vessel 4 they are driven at a correspondingly higher transport speed; after a sufficiently large stock of material 2*a* has been achieved in the storage vessel 4 the transport speed of these rollers 17, 17*a*can be markedly reduced or they can even be temporarily stopped in order to facilitate the drawing near of a new length of material (new material batch).

In general it will be sufficient to construct the storage vessel 4 in the manner described above and illustrated in the drawing with two break rollers, i.e. one break roller 11 or 12 for each shaft 5, 7 respectively, in the central region of its height, so that at present-day high transport speeds a sufficient time is allowed for the manipulation on the stationary end of the length of material in the (with a correspondingly large stock of material in the storage vessel 4). However, in the case of a storage vessel 4 with very high shafts it can sometimes be advantageous if in addition to the first break rollers 11, 12 which can be moved outwards from the interior into the cross-section of the shaft at least one second break roller is provided in each shaft above and/or below these first break rollers but is movable from the outer wall of the shaft into the cross-section of the shaft so as to ensure that the length of material runs in a sufficiently strong zig-zag pattern and thus winds sufficiently well around the break rollers.

It also goes without saying that in particular the first two rollers 11, 12 can be moved from the inner faces of the two shaft into the appertaining shaft cross-section in any suitable manner, i.e. by all suitable means, for example with the aid of slide or rail guides. However, the way in which the pivotability is realised as explained with the aid of the drawing (with the pivot frame 13) constitutes a particularly simple and advantageous design for achieving this object.

In the material store according to the present invention as described above it can also be particularly advantageous to arrange an impulse counter of a construction which is known per se in the regin of the material inlet (that is to say in the region before the delivery shaft 5) and in the region of the material outlet (that is to say after the extraction shaft 7) and to store the impulses from it so that an overview is produced of the stock of material in the store at any one time, and during the emptying of the storage vessel 4 at a specific quantity of material a signal is passed from the impulse counter to the drive means for the first transport arrangement 8 provided above the delivery shaft 5 (to feed the length of material into the storage vessel 4) so that this drive means can be so that the transport speed is in an adjustable ratio to the machine speed of the treatment apparatus, so that when the compensating roller 18*b* responds it is only necessary to equalise or synchronise a small difference in speeds.

We claim:

1. Material store for the through transport of a length of textile material between successive treatment machines, containing (a) a storage vessel (4) with a substantially upright delivery shaft (5), a turn-round section (6) connected directly to the lower end of this delivery shaft round section opposite the delivery shaft.

(b) transport arrangements (8, 9) arranged above the delivery shaft (5) and the extraction shaft (7) to delivery and remove the length of material (2), characterised in that (c) a rotating turn-round device (10) for the length of material (2) is arranged at the upper end of the turn-round section (6) and in the transition region thereof from the lower end of the delivery shaft to the lower end of the extraction shaft;

(d) a break roller (11, 12) which is movable into the cross-section of the appertaining shaft from the adjacent inner face (5*a*, 7*a*) of the shafts is provided in the region between the lower and upper ends of each of the two shafts (5, 7).

2. Material store as claimed in claim 1, characterised in that the storage vessel (4) is of approximately U-shaped construction in vertical section, the two shafts (5, 7) are of approximately the same height and extend substantially parallel to one another and form the two arms of the U, and the distance between the adjacent inner faces (5*a*, 7*a*) of the two shafts is smaller than the diameter of the rotating turn-round device (10).

3. Material store as claimed in claim 2, characterised in that at least one transport roller (17, 17*a*) is provided above the upper end of the delivery shaft (5) for vertical, central delivery of the length of material (2), and at least one transport and guide roller (18, 18*a*) is provided above the upper end of the extraction shaft (7) for vertical, central removal of the length of material (2).

4. Material store as claimed in claim 1, characterised in that the two break rollers (11, 12) are mounted a certain distance apart and parallel to one another on opposite sides of a common pivot frame (13) so as to be freely rotatable, the said pivot frame being pivotable about an axis (14) which runs parallel to the break rollers and to the axis of rotation (10*a*) of the rotating turn-round device (10) between a first, active position in which the two break rollers (11, 12) are pivoted into the appertaining shafts (5, 7) for the purpose of guiding the length of material and a second, rest position in which the pivot frame (13) is kept approximately vertical and the two break rollers are pivoted out of the region of the length of mateiral (2) located in the shafts.

5. Material store as claimed in claim 4, characterised in that the pivot frame (13) is constructed in the manner of a two-armed lever and a pivot drive (15) engages on one lever arm (13*a*).

6. Material store as claimed in claim 4, characterised in that the pivot frame (13) is constructed in such a way that in its rest position it is accommodated in the region between the adjacent inner faces (5*a*, 7*a*) of the two shafts 5, 7).

7. Material store as claimed in claim 3, characterised in that a layering device (19) which can be switched on and off is provided between the upper end of the delivery shaft (5) and the transport and guide roller (17*a*) to feed the length of material (2) in the folded state into the storage vessel (4).

8. Material store as claimed in claim 3, characterised in that the transport and guide roller(s) located above the upper end of the delivery shaft (5) can be driven at a variable transport speed.

9. Material store as claimed in claim 1, characterised in that the rotating turn-round device in the turn-round section (6) is formed by a turn-round roller (10) which is arranged so as to be stationary and is mounted so as to be freely rotatable.

10. Material store as claimed in claim 1, comprising one or more additional break rollers, disposed in the region between the lower and upper ends of the two shafts, which additional break rollers can be removed into the cross-section of the appertaining shaft from the adjacent innerfaces of the two shafts.

* * * * *